US005594475A

United States Patent [19]

Komakine et al.

[11] Patent Number: 5,594,475

[45] Date of Patent: Jan. 14, 1997

[54] INK JET PRINTER HEAD AND A METHOD OF DRIVING THE SAME

[75] Inventors: Shigeo Komakine; Kuniaki Ochiai; Kazunori Mine, all of Shizuoka, Japan

[73] Assignee: Kabushiki Kaisha TEC, Shizuoka, Japan

[21] Appl. No.: 297,032

[22] Filed: Aug. 26, 1994

[30] Foreign Application Priority Data

Aug. 27, 1993 [JP] Japan ..... 5-212845

[51] Int. Cl.[6] ..... B41J 2/045

[52] U.S. Cl. ..... 347/9; 347/12; 347/40; 347/69

[58] Field of Search ..... 347/69, 71, 9, 347/12, 11, 40, 94

[56] References Cited

U.S. PATENT DOCUMENTS

| | | | |
|---|---|---|---|
| 4,639,735 | 1/1987 | Yamamoto et al. | 347/9 |
| 5,193,256 | 3/1993 | Ochiai et al. | 347/71 |
| 5,248,998 | 9/1993 | Ochiai . | |
| 5,266,965 | 11/1993 | Komai et al. | 347/12 |
| 5,301,404 | 4/1994 | Ochiai . | |
| 5,311,218 | 5/1994 | Ochiai . | |
| 5,311,219 | 5/1994 | Ochiai . | |
| 5,327,627 | 7/1994 | Ochiai . | |
| 5,351,375 | 10/1994 | Ochiai . | |

FOREIGN PATENT DOCUMENTS

| | | | |
|---|---|---|---|
| 0513971 | 11/1992 | European Pat. Off. . | |
| 0533506 | 3/1993 | European Pat. Off. . | |
| 63-247051 | 10/1988 | Japan . | |
| 4-369542 | 12/1992 | Japan | 347/12 |

*Primary Examiner*—Mark J. Reinhart
*Attorney, Agent, or Firm*—Oblon, Spivak, McClelland, Maier & Neustadt, P.C.

[57] ABSTRACT

An ink jet print head includes pressure chambers divided by side walls formed at least partially of a piezoelectric member, voltage is applied to electrodes formed on surface of side walls, and jets ink in the pressure chambers through ink jets by causing deformation of shearing strain mode to the side walls. Each one of the side walls disposed on both sides of the pressure chambers has different operating characteristics. The volume of the ink to be jetted can be changed in three ways by selectively deforming either of the side walls of the pressure chamber from which the ink is to be jetted or by deforming both of the side walls of the pressure chamber simultaneously. Accordingly, gradation can be acquired by a simply constructed print head.

14 Claims, 8 Drawing Sheets

INK JET PRINTER HEAD AND A METHOD OF DRIVING THE SAME

BACKGROUND OF THE INVENTION

1. Field of the Invention

The present invention relates to a drop-on-demand ink jet print head mounted on an ink jet printer and a method of driving the same.

2. Description of the Related Art

A conventional ink jet print head is disclosed in Japanese Patent Laid-open (Kokai) No. Sho 63-247051. FIG. 1 shows a passage (a pressure chamber) having a hard wall on one side and a shearing strain actuator wall on the other side. The shearing strain actuator wall consists of piezoelectric ceramic. An upper portion and a lower portion of these walls are joined to each other on their boundary surfaces thereof. They are also fixedly joined to a top wall and a bottom wall. Metallized metal electrodes are formed on surfaces of the both walls of the shearing strain actuator disposed on one side of the two side walls.

In the above-described ink jet printer having the shearing strain actuator on one side of the two side walls, the actuator wall is deformed toward the passage and thus pressure is provided to ink throughout the entire length of the passage, as a shearing deformation is caused in the piezoelectric ceramic by applying a pulse voltage between the electrodes. If the pressure against the ink thus applied is beyond the predetermined minimum value, the ink is jetted through a nozzle.

Also, FIG. 9(*a*) in the above mentioned Laid-open discloses the ink jet print head having a pair of shearing strain actuators formed on both sides of passage walls. An upper and lower portions of the passage consist of a top wall and a bottom wall. Electrodes of the actuators are formed on an inner surface of the passage and two surfaces on outside of both walls of the passage in the form of metal electrodes.

In the ink jet print head having the shearing strain actuators formed on both passage walls, when voltage is applied across the electrodes on the inner surface of the passage and the electrodes on the outside of the both walls of the passage, the equal amount of electric field is provided to the actuators on each wall of the passage reversely. Therefore, each wall facing the passage is deformed toward the passage and pressure is provided to ink in the passage thereby to jet an ink droplet through the passage.

The above mentioned Laid-open also describes that the size of an ink droplet can be controlled by changing the voltage to be applied.

However, the conventional ink jet print heads stated above have following disadvantages. There has been a large demand for graphic printing lately by requirements of users and an improvement of Host computer, etc. In order to print a graphic of a good quality, gradation is a critical factor.

Two types of the ink let print head are disclosed in the above mentioned Laid-open, i.e., the ink jet print head which jets ink by driving an actuator formed on one side of a passage (pressure chamber), and the ink jet print head which jets ink by simultaneously changing similar actuators respectively formed on both sides of a passage. In any case, pressure variation in a pressure chamber is utilized by changing the voltage to be applied in order to change the size of a droplet. Therefore, the same number of voltages to be applied as the number of gradation degrees is required. Also, an apparatus to switch a connection of a plurality of electric sources corresponding to the gradation degrees and electrodes of each actuator is required which is costly.

SUMMARY OF THE INVENTION

A first object of the present invention is to provide an ink jet print head and a method of driving the same which perform gradation in graphic printing with a simply constructed device.

A second object of the present invention is to provide an ink jet print head and a method of driving the same which perform gradation in the graphic printing by a unique control.

A third object of the present invention is to provide an ink jet print head and a method of driving the same which perform gradation in the graphic printing without changing the structure of device as compared with conventional ink jet print head and a method of driving the same.

A fourth object of the present invention is to provide an ink jet print head and a method of driving the same which perform gradation in the graphic printing at a low cost.

An ink jet print head according to the present invention has a plurality of pressure chambers and electrodes, ink jets and driving units corresponding to the pressure chambers. Pressure chambers are divided by side walls at least partially formed of a piezoelectric member. The electrodes are formed on surfaces of the side walls such that they contact the piezoelectric member in the pressure chambers. Ink jets are formed to communicate with the pressure chambers so as to jet ink in the pressure chambers. A control unit applies voltage to an electric source to deform the side walls in shearing strain mode thereby to jet the ink through the ink jets. The piezoelectric member is driven such that voltage to be applied to the electrode corresponding to one side walls and to the other side walls of the pressure chamber differ. Accordingly, pressure in the pressure chamber varies In three ways, i.e., 1) when driving only one side wall of the pressure chamber, 2) when driving only the other side walls of the pressure chamber, and 3) when driving both side walls of the pressure chambers. The size of the droplet can be controlled by changing the pressure in the pressure chambers as mentioned above. Therefore, the gradation can be readily acquired only by setting two driving voltage values.

An ink jet print head according to other aspect of the present invention has a plurality of pressure chambers and electrodes, ink jets and driving units corresponding to the pressure chambers. Pressure chambers are divided by side walls at least partially formed of a piezoelectric member. Each side wall formed on both sides of the pressure chamber has different operating characteristic of shearing strain mode. The electrodes are formed on the surfaces of the side walls so that they contact the piezoelectric member in the pressure chamber. Ink jets are formed communicating with the pressure chambers so as to jet ink in the pressure chambers. A control unit applies voltage to an electric source to deform the side walls in shearing strain mode and to drive the piezoelectric member thereby to jet the ink in the pressure chamber through the ink jets. Accordingly, pressure in the pressure chambers varies in three ways, i.e., 1) when driving only one side walls of the pressure chambers, 2) when driving only the other side wails of the pressure chambers, and 3) when driving both side walls of the pressure chambers. The size of the droplet can be controlled by changing the pressure in the pressure chamber as mentioned above. Therefore, gradation can be readily acquired by setting a driving voltage value.

A method of driving an ink jet print head according to the present invention uses the ink jet print head comprising a plurality of pressure chambers and electrodes, ink jets and driving units corresponding to the pressure chambers. Pressure chambers are divided by side walls at least partially formed of a piezoelectric member. The electrodes are formed on side wall surfaces such that they contact the piezoelectric member in the pressure chambers. Ink jets are formed communicating with the pressure chambers so as to jet ink in the pressure chambers. A control unit applies voltage to an electric source to deform the side walls in shearing strain mode and to drive the piezoelectric member thereby to jet the ink through the ink jets. In above mentioned ink jet print head, different voltage is applied to the electrodes corresponding to the one side walls and to the other side walls of the pressure chambers. Accordingly, the voltage to be applied to the electrodes can be varied in every pressure chamber in three ways, i.e., 1) when deforming only one side wall of the pressure chamber, 2) when deforming only the other side wall of the pressure chamber, and 3) when deforming both side walls of the pressure chamber. The size of the droplet can be controlled by changing the pressure in the pressure chamber as mentioned above. Therefore, gradation can be readily acquired.

A method of driving an ink jet print head according to other aspect of the present invention uses the ink jet print head comprising a plurality of pressure chambers and electrodes, ink jets and driving units corresponding to the pressure chambers. The pressure chambers are divided by side walls at least partially formed of a piezoelectric member. The electrodes are formed on surfaces of the side walls such that they contact the piezoelectric member in the pressure chambers. Ink jets are formed communicating with the pressure chambers so as to jet ink in the pressure chambers. A control unit applies voltage to an electric source to deform the side walls in shearing strain mode and to drive the piezoelectric member thereby to jet the ink through the ink jets. In above mentioned ink jet print head, all the electrodes are alternately connected to two electric sources having different voltage in every two pressure chambers. Accordingly, the pressure in the pressure chambers varies in three ways when the voltage is applied to 1) the electrodes on one side of the pressure chambers, 2) to the electrodes on the other side of the pressure chambers or 3) to the electrodes on both sides of the pressure chambers to change the size of the droplets, as well as earthing the electrodes in the pressure chambers from which a droplet is to be jetted. Therefore, gradation can be readily acquired.

A method of driving an ink jet print head according to other aspect of the present invention uses the ink jet print head comprising a plurality of pressure chambers and electrodes, ink jets and driving units corresponding to the pressure chambers. Pressure chambers are divided by side walls at least partially formed of a piezoelectric member. The electrodes are formed on surfaces of the side walls such that they contact the piezoelectric member in the pressure chambers. Ink jets are formed communicating with the pressure chambers so as to jet ink in the pressure chambers. A control unit applies voltage to an electric source to deform the side walls in shearing strain mode and to drive the piezoelectric member thereby to jet the ink through the ink jet outlets. In above mentioned ink jet print head, voltage is applied to the electrodes in every pressure chamber when 1) deforming the walls on one side of each pressure chambers, 2) when deforming the walls on the side of each pressure chambers, or 3) when deforming the walls on both side walls of each pressure chambers. In this case, operating characteric of shearing strain mode of one side of the pressure chambers is different from that of the other side of the pressure chambers. Therefore, as the pressure in the pressure chambers can be varied in three ways thereby to change the size of the droplets, gradation can be readily acquired.

BRIEF DESCRIPTION OF THE DRAWINGS

These and other objects and advantages of this invention will become more apparent and more readily appreciated from the following detailed description of the presently preferred exemplary embodiments of the invention taken in conjunction with the accompanying drawings wherein.

DETAILED DESCRIPTION OF PREFERRED EMBODIMENTS

A first embodiment of the present invention will be described hereinafter with reference to FIG. 1 to FIG. 6. A structure of an ink jet print head according to the present invention will be described with reference to FIG. 4 to FIG. 6 in order of fabricating steps thereof.

Figure 4A:
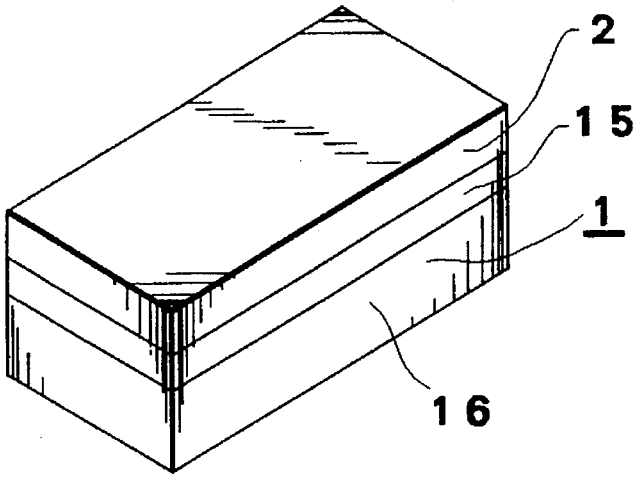
FIG. 4(A) is a perspective view illustrating a fabricating step (a).
Figure 4B:
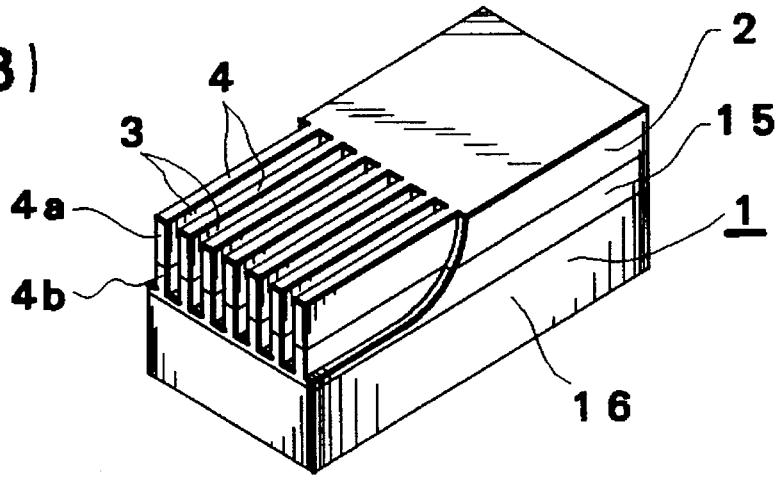
FIG. 4(B) is a perspective view illustrating a fabricating step (b) for forming grooves by grinding and a fabricating step (c) for implementing a pretreatment for electroless plating.

Step (a):

First, a base plate 1 is formed as shown in FIG. 4(A) by coating a resin adhesive containing as a principal component an epoxy resin having a high bonding strength over a bottom plate 16 of aluminum or glass having a high rigidity and a low thermal deformation. A piezoelectric member 2 polarized in the direction of its thickness is put on the adhesive, Then, the bottom plate 16, bottom layer 15 consisting of the adhesive and the piezoelectric member 2 are joined together to form three overlapped layers by hardening the adhesive.

Step (b):

Consequently, a plurality of parallel grooves 3 are formed at predetermined intervals through the surface of the piezoelectric member 2 into the bottom layer 15 by grinding. This also forms side walls 4 on both sides of the grooves 3. The side walls 4 consist of an upper side wall 4*a* formed of the piezoelectric member and a lower side wall 4*b* formed of the bottom layer 15 having lower rigidity than that of the piezoelectric member 2.

Step (c):

The base plate 1 is then subject to washing, catalyzing and accelerating treatment as a pretreatment before forming electrodes by electroless plating.

The base plate 1 is washed to activate plated surfaces and to make it hydrophilic such that catalyzing liquid, accelerating liquid and plating liquid can readily flow into the grooves 3.

Catalyzing treatment is carried out to adsorb Pd-Sn complex on inner surfaces of the grooves 3 by immersing the base plate 1 in the catalyzing liquid used as pretreatment liquid, containing Palladium chloride, Stannous chloride, concentrated Sulfuric acid and the like. Pd-Sn complex is deposited on the surfaces of upper side walls 4*a* and lower walls 4*b* forming each groove 3.

Acceleration treatment is carried out to catalyze the complex deposited by catalyzing treatment such that the complex deposited on the side walls 4 becomes metallized Pd, i.e., a catalyst core.

Figure 4C:
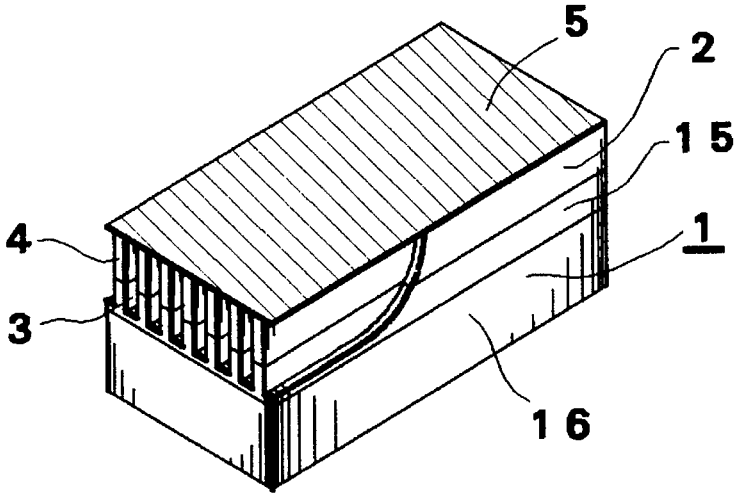
FIG. 4(C) is a perspective view illustrating a fabricating step (d) for forming a mask over a piezoelectric member.

Step (d):

A mask is formed over the surface of the piezoelectric member 2. This is carried out by purring a dry film 5 on the surface of the piezoelectric member 2 as shown in FIG. 4(C).

Figure 5A:
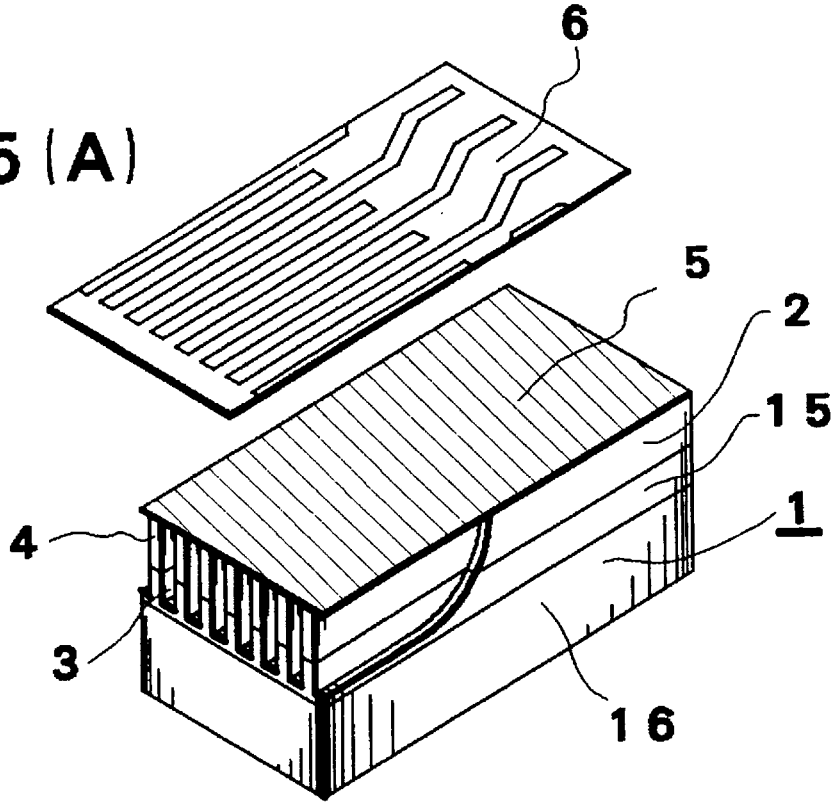
FIG. 5(A) is a perspective view illustrating a fabricating step (e) for implementing an exposure and development process with a resist mask placed on the piezoelectric member.
Figure 5B:
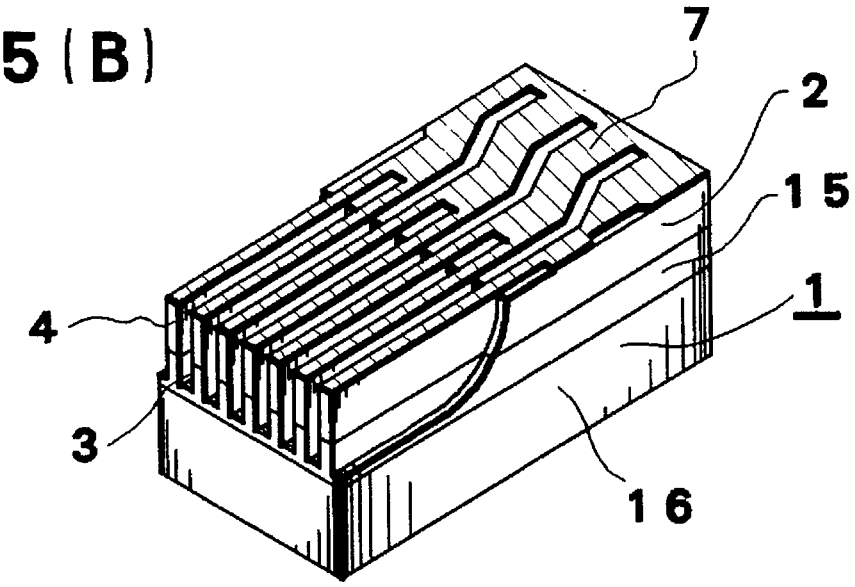
FIG. 5(B) is a perspective view illustrating a fabricating step (e) when the exposure and development process is finished.

Step (e):

A resist mask 6 is placed on the dry film 5 excluding portions in which a wiring pattern to be formed as shown in FIG. 5(A). Then, the dry film 5 is exposed to light and subject to development, Consequently, as shown in FIG. 5(B), resist film 7 formed with the dry film 5 remains over the surface of the piezoelectric member 2 excluding portions in which the wiring pattern is to be formed. Therefore, the metallized Pd is exposed on the wiring pattern of the piezoelectric member 2 and on the inner surface of the grooves 3.

Step (f):

Then, the base plate 1 is immersed in a plating bath for electroless plating. The plating bath contains a metallic salt and a reducing agent as principal components and additives such as a pH regulator, a buffer, a complexing agent, an accelerator, a stabilizer and a modifier. A plate is formed around metallized Pd used as a catalyst core thereby forming electrodes 8 on the surface of the grooves 3 in the side walls 4 and on the wiring pattern 9 communicating with the electrodes 8 on the piezoelectric member 2 shown in FIG. 6(A).

Figure 1:
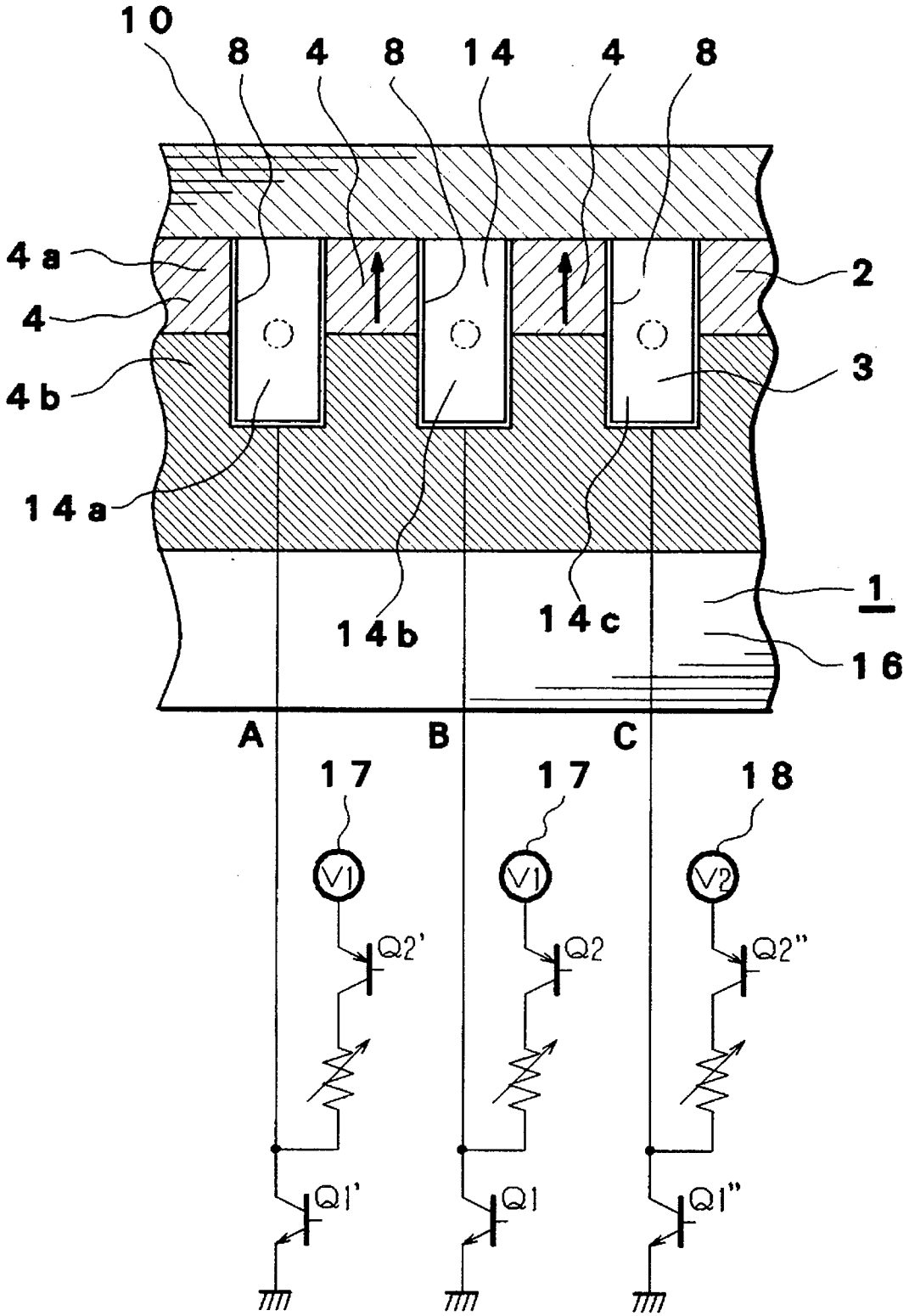
FIG. 1 is a longitudinal sectional rear views of an ink jet print head including driving circuits according to a first embodiment of the present invention.
Figure 6A:
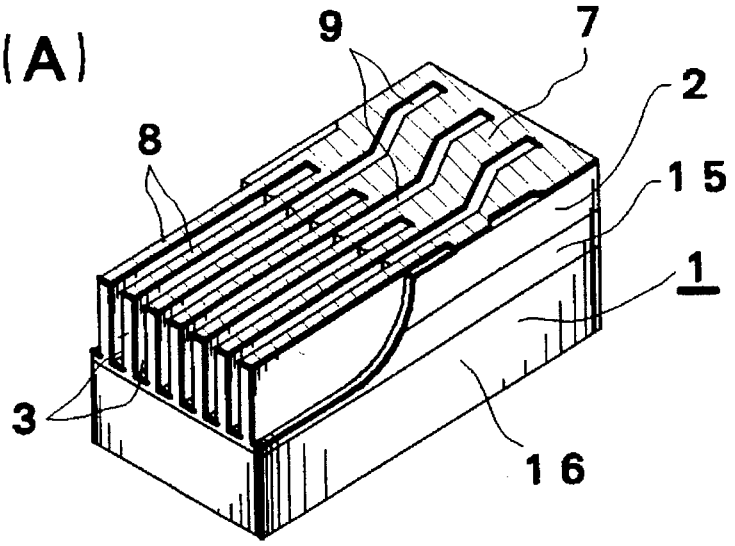
FIG. 6(A) is a perspective view illustrating a fabricating step (f) for electroless plating.
Figure 6B:
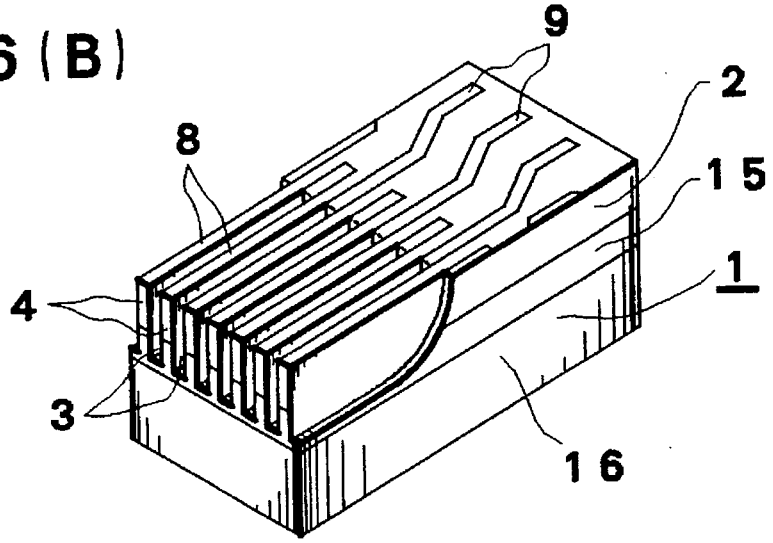
FIG. 6(B) is a perspective view illustrating a fabricating step (g) for peeling off the resist film.
Figure 6C:
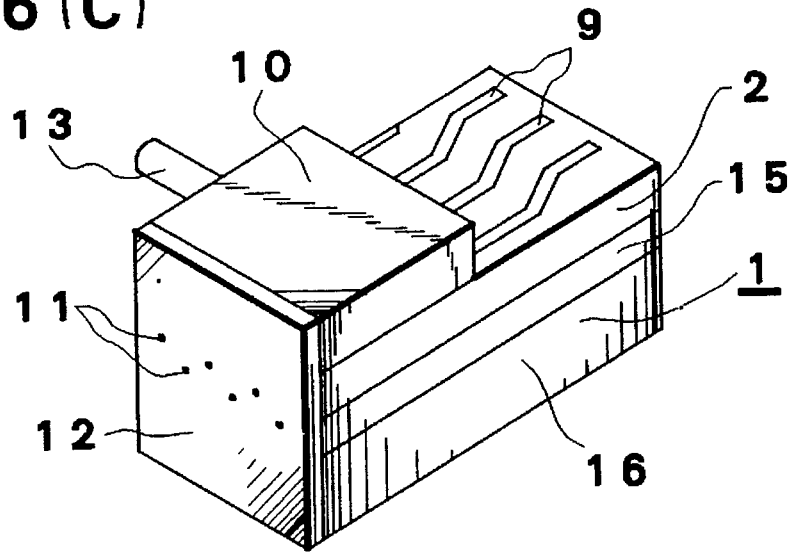
FIG. 6(C) is a perspective view illustrating a fabricating step (g) when the all the steps are finished and an ink jet print head is completed.

Step (g):

The resist film 7 placed on the surface of the piezoelectric member 2 is peeled off as shown in FIG. 6(B). Then, a top plate 10 is attached to the surface of the piezoelectric member 2 at which the plurality of parallel grooves 3 are formed and a nozzle plate 12 having ink jets 11 formed thereon is fixedly attached to the side surface of the base place 1 and the top plate 10. The ink jets 11 are communicating with the tips of the each groove 3. As shown in FIG. 1, the grooves 3 are closed by the top plate 10 to form pressure chambers 14. Before attaching the nozzle plate 12, side surfaces of the base plate 1 and the top plate 10 on which the nozzle plate 12 is attached should be ground to align the side surfaces thoseof. An ink supply pipe 13 is attached to top plate 10 to supply ink to each grooves 3 from an ink supply passage (not shown) and the ink jet print head is finally completed.

FIG. 1 also shows that all the electrodes 8 in every two pressure chambers are alternately connected to two electric sources 17, 18 having different voltage. The electric source 17 applies the voltage V1 and the electric source 18 applies the voltage V2. The combination of the electric sources 17, 18 and the electrodes 8 are determined such that the voltages V1 and V2 are applied to the electrodes 8 formed in the pressure chambers 14 adjacent to each other in order of V1, V1, V2, V2, V1, V1, . . . .

In FIG. 1, numeral 14*b* refers to a middle pressure chamber, 14*a* indicates a pressure chamber disposed on the left-hand side of middle pressure chamber 14*b* and 14*c* designates a pressure chamber disposed on the right-hand side of middle pressure chamber 14*b*. A first electric field is applied to the left side wall 4 defining the middle pressure chamber 14*b* by the voltage V1 when transistors Q1, Q2' are on. Also, a second electric field reverse to the first electric field is applied to the right side wall 4 defining the middle pressure chamber 14*b* by the voltage V2 when transistors Q1, Q2" are on.

Figure 2:
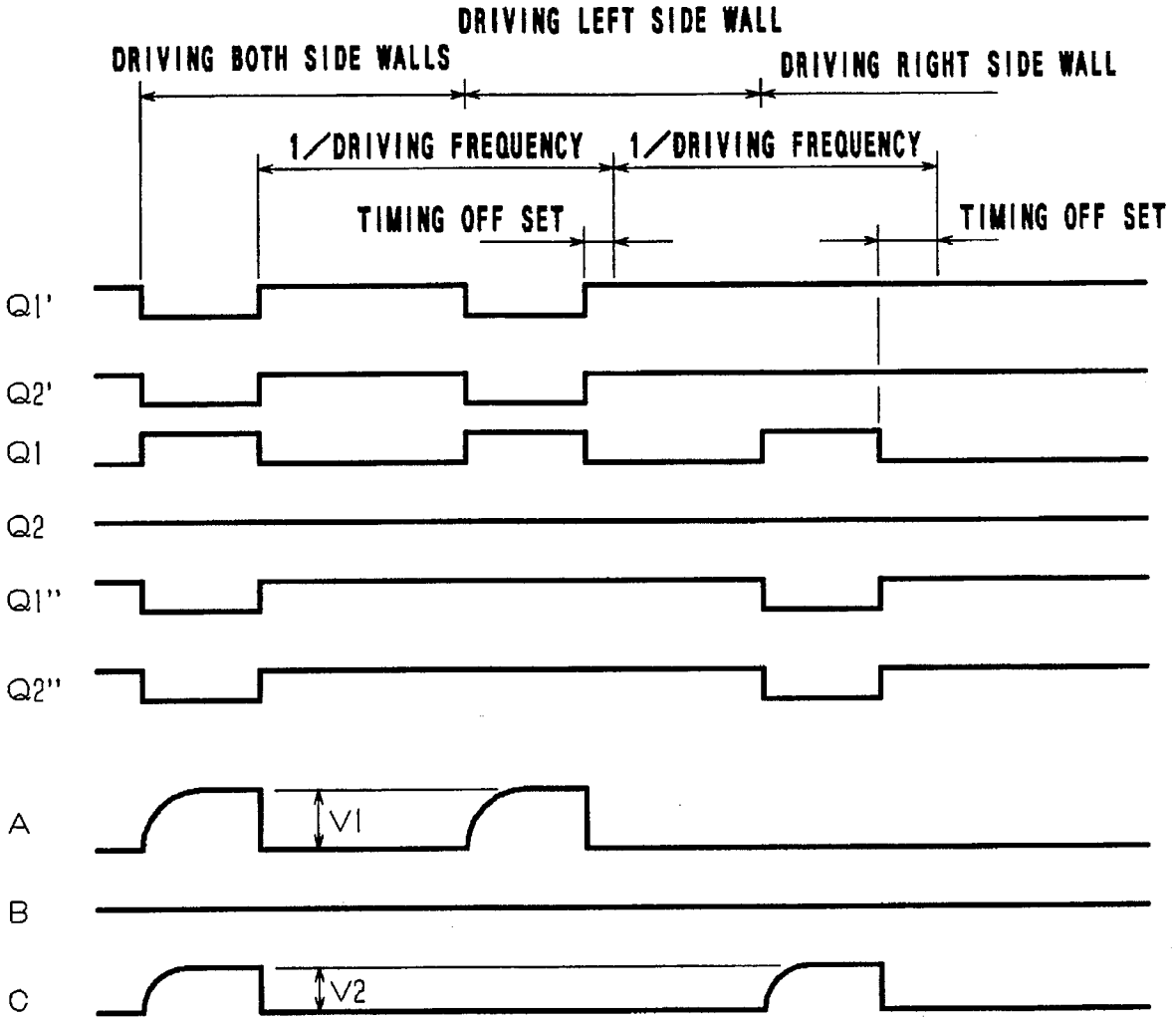
FIG. 2 is a timing chart showing status of voltage applied to electrodes.

A method of driving the ink jet print head will be described hereinafter in jetting ink through the pressure chamber 14*b* shown in FIG. 1. Timing chart in FIG. 2 shows operating waveforms of the transistors Q1, Q2, Q1', Q2', Q1", Q2" shown in FIG. 1. Potential B is applied to the electrode 8 in the middle pressure chamber 14*b* through which the ink is to be jetted, potential A is applied to the electrode 8 in the left-hand side pressure chamber 14*a* and potential C is applied to the electrode 8 in the right-hand side pressure chamber are respectively shown in correspondence with the operating waveforms.

Figure 3A:
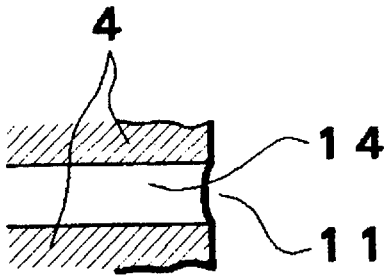
FIG. 3(A) is a sectional view of ink jet illustrating a status of ink held by surface tension.

As shown in FIG. 3(A), meniscus in the ink jet 11 is generally held in the shape of a concave by the surface tension in the initial stage.

Figure 3B:
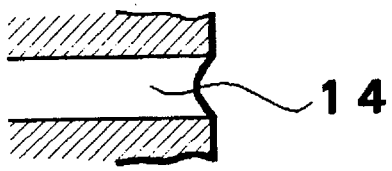
FIG. 3(B) is a sectional view of an ink jet illustrating status of ink when pressure in pressure chamber is reduced.

Electric field generated by the voltage V1 is gradually applied to the left side wall 4 of the middle pressure chamber 14*b* and electric field by voltage V2 is also applied to the right side wall 4 of pressure chamber 14*b* respectively when transistors Q1, Q2, Q2" are on and Q1', Q1", Q2 are off. Both side wails in the middle pressure chamber 14*b* are then gradually deformed outwardly by the shearing strain of piezoelectric member 2 of side walls such that the volume of the middle pressure chamber 14*b* is increased and the pressure therein is reduced. Consequently, ink is supplied to the middle pressure chamber 14*b* from an ink supply unit (not shown) and the meniscus in the ink jet 11 is slightly backed as shown in FIG. 3(B). The volumes of the right and left pressure chambers 14*a*, 14*c* are compressed when the volume of the middle pressure chamber 14*b* is increased. However, the volume of the middle pressure chamber is changed gradually, ink is not jetted through the ink jets 11 of right and left-hand side pressure chamber 14*a*, 14*c*.

Figure 3C:
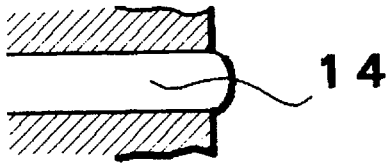
FIG. 3(C) is a sectional view of the ink jet illustrating status of ink resulting from the status shown in FIG. 3(B) when the pressure is increased in the pressure chamber.
Figure 3D:
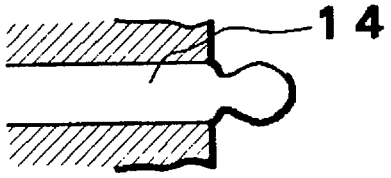
FIG. 3(D) is a sectional view of the ink jet illustrating status of ink resulting from the status shown in FIG. 3(C) when an ink droplet is grown.
Figure 3E:
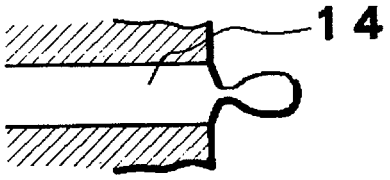
FIG. 3(E) is a sectional view of the ink jet illustrating status of the ink droplet having a pinch resulting from the status shown in FIG. 3(D).
Figure 3F:
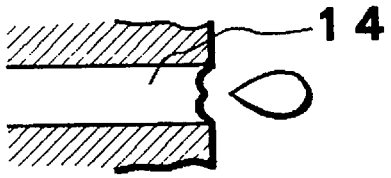
FIG. 3(F) is a sectional view of the ink jet outlet illustrating status of ink resulting from the status shown in FIG. 3(E) when the ink droplet is jetted.

When the transistors Q1, Q2', Q2" are turned off and Q1', Q1" are turned on, the potential V1, V2 applied respectively to the electrodes 8 in the pressure chamber 14*a*, 14*c* are earthen rapidly. Accordingly, the side walls 4 defining the middle pressure chamber 14*b* are sharply deformed inwardly as the piezoelectric member 2 restores its original shape. As the volume of the middle pressure chamber 14*b* is rapidly decreased and the pressure therein is increased, the ink droplet grows at ink jet 11 as shown in FIGS. 3(C), (D) and starts to fly through the ink jet 11 of the middle pressure chamber 14*b*. The pressure in the pressure chambers 14 varies as time passes. When time L/a (L indicates a length of the pressure chambers 14, a indicates a velocity of the pressure wave in the pressure chambers 14) has passed from time the pressure was applied to ink, the pressure in the vicinity of the ink jet 11 drops to a negative pressure and the ink droplet to be jetted is shaped in an elongated ellipsoid (FIG. 3(E)). The ink droplet is then separated naturally (FIG. 3(F)). The method of driving of the ink jet print head in jetting a large droplet by simultaneously driving both side walls 4 defining the middle pressure chamber 14*b* was thus described.

An operation of driving the ink jet print head in jetting a small ink droplet by driving each side wall 4 of the middle pressure chamber 14*b* alternately will be described. The basic operation and the meniscus in the vicinity of the ink jet 11 are similar to what is stated above so that it will be described briefly.

First, a potential difference is generated between the electrodes 8 in the middle pressure chamber 14*b* and those in the left-hand side pressure chamber 14*a* when the transistors Q1, Q2' are on and the transistor Q1' is off to operate the left side wall 4 of the middle pressure chamber 14*b* by the voltage V1. Consequently, the left side wall 4 of the middle pressure chamber 14*b* is gradually deformed outwardly as the shearing strain occurs in the piezoelectric member 2 of left side wall 4. Therefore, the volume in the middle pressure chamber 14*b* is increased and the pressure therein is reduced to a negative pressure. The ink is then supplied to the middle pressure chamber 14*b*. At this moment, the right side wall 4 is not deformed. This is because no potential difference is produced between the electrode 8 in the middle pressure chamber 14*b* and that in the right-hand side pressure chamber 14*c* and thus no electric field is provided to the piezoelectric member 2 there between.

Secondly, the potential V1 applied to the electrode 8 in the pressure chamber 14*a* is grounded instantaneously when the transistors Q1, Q2' are turned off and transistors Q' is turned on. Consequently, the left side wall 4 of the middle pressure chamber 14*b* is deformed inwardly such that the volume of the middle pressure chamber 14*b* is decreased rapidly and the pressure therein is increased. The ink is then jetted through the ink jet 11 thereof.

Thirdly, only the right side wall 4 of the middle pressure chamber 14*b* is driven by the voltage V2, which is predetermined to be smaller than the voltage V1. A potential difference is generated between the electrode 8 in the middle pressure chamber 14*b* and that in the adjacent right-hand side pressure chamber 14*c* when the transistors Q1, Q2" are on and transistor Q1" is off. Consequently, the right side wall 4 of the middle pressure chamber 14*b* is gradually deformed outwardly as the shearing strain occurs in the piezoelectric member 2 of right side wall 4. Therefore, the volume of pressure chamber 14*b* is increased and the pressure therein is reduced to a negative pressure. Ink is then supplied to the middle pressure chamber 14*b* from the ink supply unit (not shown). At this moment, the left side wall 4 is not deformed. This is because no potential difference is produced between the electrodes 8 in the middle pressure chamber 14*b* and that in the left-hand side pressure chamber 14*a* and thus no electric field is provided to the piezoelectric member 2 there between.

Then, the potential V2 applied to electrode 8 in the pressure chamber 14*c* is instantaneously earthen when the transistors Q1, Q2" are off, and the transistor Q1" is on. Consequently, the right side wall 4 of the middle pressure chamber 14*b* is rapidly deformed inwardly. Therefore, the volume of pressure chamber 14*b* is rapidly decreased and the pressure therein is increased. Ink is then jetted through the ink jet 11 of the middle pressure chamber 14*b*.

As the ink is jetted by driving only either one of the side walls 4 in the middle pressure chamber 14*b*, a jetted ink is smaller than that jetted by driving both side walls 4. Also, since the voltage V2 for driving the right side wall 4 is smaller than the voltage V1 for driving the left side wall 4, a jetted ink droplet is smaller when driving the right side wall 4 than when driving the left side wall 4. Therefore, three different sizes of an ink droplet can be selected by applying two different voltage V1, V2 respectively to one side wall 4 and to the other side wall 4 defining the pressure chamber 14 to change the operating charasteric of the side walls 4.

The size of the ink droplet is changed by connecting the electrodes to a plurality of electric sources and by switching the connection as in the conventional art. According to the present invention, as switching the connection line between two electrodes 8 and two different electric sources is not necessary, the electric circuits can be simple.

The pressure increased in the pressure chambers 14 differs when driving both side walls 4 from when driving each one of them separately. The flying speed of the ink droplet can be changed in correspondence with the differences in pressure. When respectively driving both side walls 4 and one side wall 4 by applying the voltage for the same period of time at a low printing frequency, timing offset is not noticeable on a printed surface. However, when driving at a high printing frequency, positions of jetted ink droplets on the printed surface (paper) are shifted considerably according to the pressure difference in the pressure chambers 14 thereby degrading printing accuracy. Accordingly, the timing of driving one side wall 4 should be earlier than that of driving the both side wails 4 according to the difference in the flying speed of droplets. In other words, a first driving in which voltage is supplied to one side wall 4 should be executed prior to a second driving in which voltage is supplied to both side walls 4 by the amount of time difference that the droplets reach the printing surface between first and second drivings (timing offset is shown in FIG. 2). Therefore, jetted positions of ink droplet on the printing surface in the first driving can be the same as that in the second driving to carry out a high speed printing.

Figure 7:
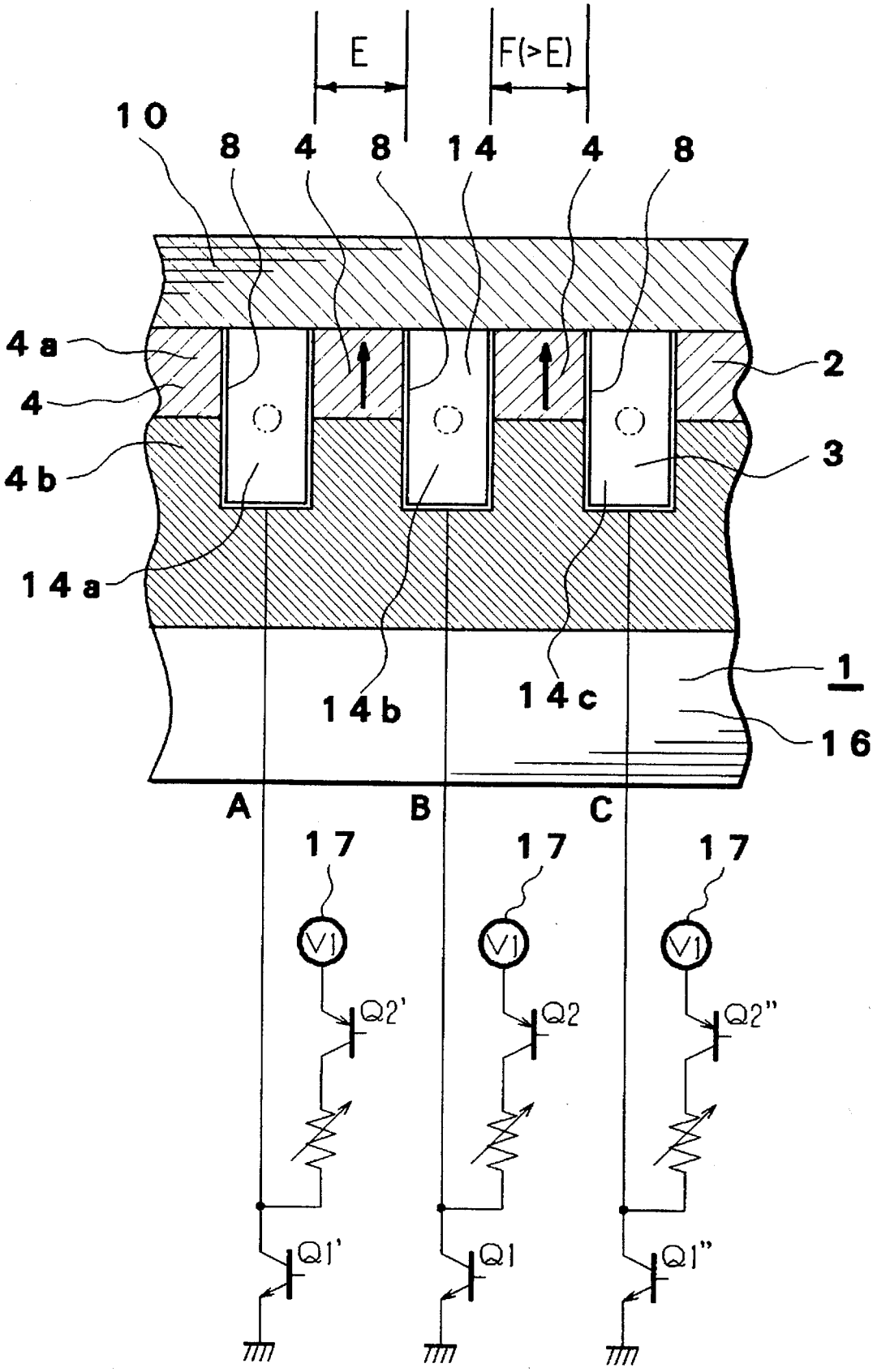
FIG. 7 is a longitudinal sectional rare view of an ink jet print head including driving circuits according to a second embodiment of the present invention.
Figure 8:
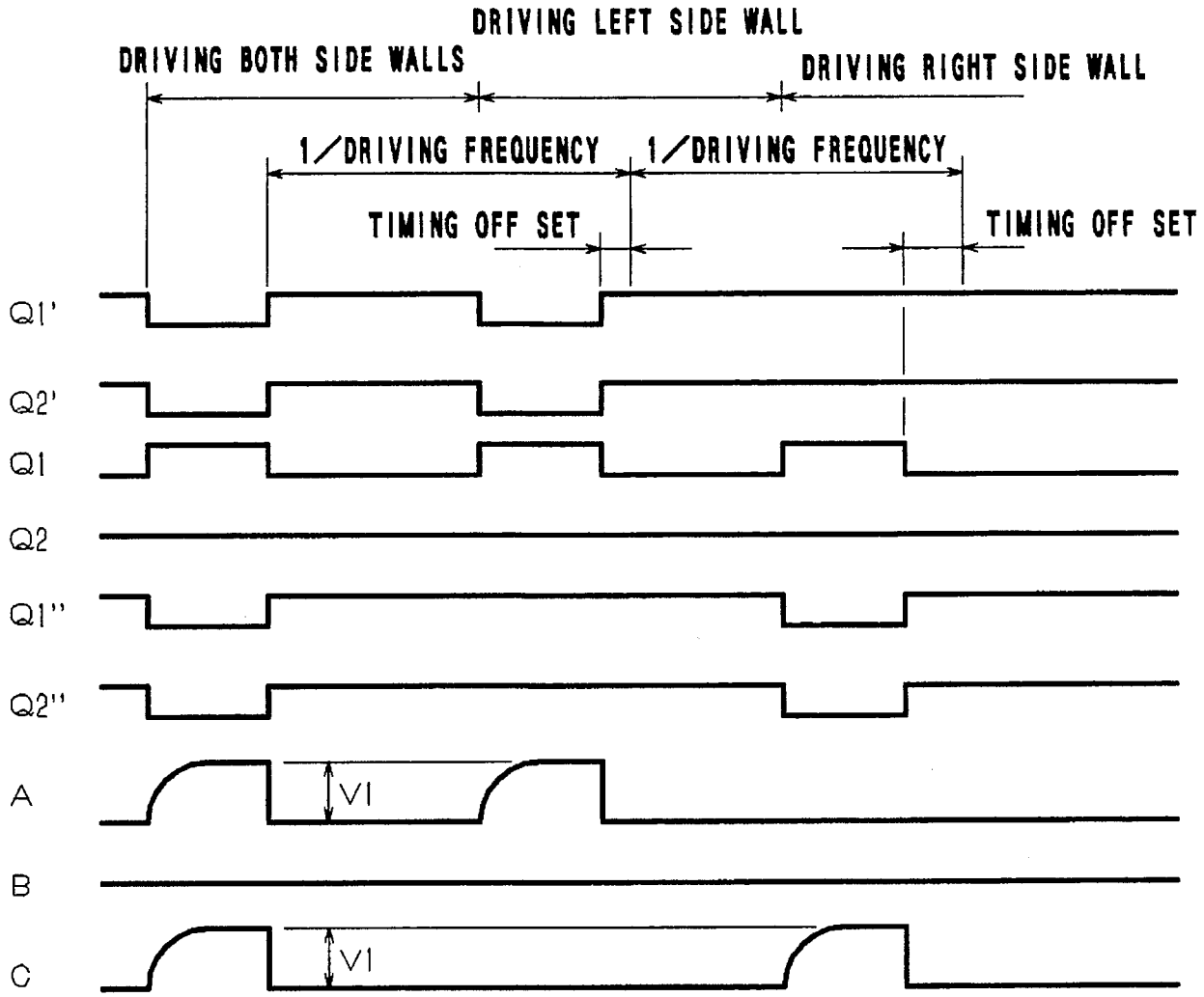
FIG. 8 is a timing chart showing status of voltage applied to electrodes.

Now, a second embodiment of the present invention will be described with reference to FIGS. 7 and 8. Numerals used in the first embodiment are also used in this embodiment to indicate similar elements there-between. An ink jet print head is fabricated in the same order as the first embodiment. However, intervals between grooves 3 are alternately different such that width of each side wall 4 along the array of the pressure chambers 14 are alternately different from one another. Steps are as the same as those in the first embodiment after step for forming the grooves 3. FIG. 7 shows a sectional structure of the pressure chambers 14 in this embodiment. The same voltage V is applied to electrodes 8 in each pressure chamber 14 from the corresponding electric sources 17.

In the ink head print head thus constructed, a middle pressure chamber 14*b*, a left-hand side pressure chamber 14*a* and a right-hand side pressure chamber 14*c* are shown in FIG. 7. The operation of the ink head print head will be described in jetting ink through the middle pressure chamber 14*b*. FIG. 8 shows a timing chart of operating waveforms of transistors Q1, Q2, Q1', Q2', Q1", Q2" shown in FIG. 7. Potential B, potential A and potential C respectively applied in correspondence with above stated operating waveforms to an electrode 8 in the pressure chamber 14*b* from which the ink is to be jetted, the electrode 8 in the left-hand side pressure chamber 14*a* and the electrode 8 in the right-hand side pressure chamber 14*c* are also shown. The timing chart in FIG. 8 corresponds to the one in FIG. 2.

In this embodiment, the ink droplet can be jetted in three ways i.e., 1) by driving only the left side wall 4 of the pressure chamber 14*b*, 2) by driving only the right side wall 4 or 3) by driving both side walls 4 simultaneously. As the widths of opposed side walls 4 having the pressure chamber 14*b* there between are different from each other, electric field provided to the side walls 4 can be different such that the operating characteristics of the side walls 4 can be different even though the same voltage V1 is applied to the electrodes 8 in both side walls 4 defining the pressure chamber 14*b*. Therefore, gradation can be readily controlled by changing the pressure in the pressure chamber 14 in three ways thereby changing the size of the ink droplet. The pressure in the pressure chamber 14 can be changed by driving either one of the side walls 4 or the both side walls 4 selectively.

A timing of applying the voltage for driving one side wall 4 should be earlier than that of applying the voltage for driving both side walls 4 according to a difference between the flying time of droplets in each case. Therefore, jetted positions of jetted ink droplets can be same thereby improving printing quality even when printing frequency is high. Also, the driving circuits can be simple as it requires only one electric source 17.

When the gradation is carried out by dither method using two values, i.e., whether there is a dot of the ink droplet or not, resolution degrades as gradation degree increases. However, according to the present invention, since three different gradation can be obtained by jetting three different sizes of the ink droplet, it is possible to achieve a high level gradation using dither method without degrading the resolution.

The present invention has been described with respect to specific embodiment. However, other embodiments based on the principles of the present invention should be obvious to those of ordinary skill in the art. Such embodiments are intended to be covered by the claims.

What is claimed is:

1. An ink jet printer head comprising:

a plurality of pressure chamber divided by side walls formed at least partially of a piezoelectric member;

electrodes formed on said side walls such that they contact said piezoelectric member;

ink jets formed within said pressure chambers; and means for jetting ink in said pressure chambers through said ink jets by applying voltages to said electrodes which causes deformation in shearing strain mode to said side walls, said means applying different voltages to electrodes of different side walls of each pressure chamber so as to effect different operating characteristics in shearing strain mode by said different side walls of each pressure chamber, to jet ink droplets of varying size from said pressure chambers.

2. An ink jet print head according to claim 1, wherein said means for jetting ink include, for each pressure chamber, an electric source connected to said electrodes, a first switching transistor for selectively turning on and off the connection between said electrodes and said electric source, and a second switching transistor for selectively grounding said electrodes.

3. An ink jet print head according to claim 2, wherein a voltage level of each electric source is different from that of one immediately adjacent electric source and equal to that of the other immediately adjacent electric source.

4. An ink jet print head according to claim 2, wherein the voltage levels of said electric sources varies between two values for every two consecutive electric sources.

5. An ink jet print head according to claim 1, wherein said means for jetting ink drive said piezoelectric member to ground said electrodes of a pressure chamber from which an ink droplet is to be jetted, and apply voltages selectively either to an electrode in one or both of the pressure chambers immediately adjacent to said pressure chamber, from which an ink droplet is to be jetted.

6. An ink jet print head according to claim 1, wherein said side walls include a first layer formed of a piezoelectric member and a second layer formed of a member having lower rigidity than said piezoelectric member.

7. An ink jet print head comprising:

a plurality of pressure chambers divided by side walls formed at least partially of a piezoelectric member, said side walls disposed on either side of each pressure chamber having different operating characteristics in shearing strain mode;

electrodes formed on surfaces of each of said side walls so as to contact each piezoelectric member;

ink jet formed within said pressure chambers; and means for jetting ink in said pressure chambers through said ink jets by applying voltages to said electrodes which causes deformation in shearing strain mode to said side walls, said means applying different voltages to electrodes of different side walls of each pressure chamber so as to effect different operating characteristics in shearing strain mode by said different side walls of each pressure chamber, to jet ink droplets of varying size from said pressure chambers.

8. An ink jet print head according to claim 7, wherein said side walls disposed on both sides of each one of said pressure chambers are formed of different widths along a direction of arrangement of said pressure chambers such that operational characteristics of shearing strain of side walls disposed on both sides of each pressure chamber are different from one another.

9. An ink jet print head according to claim 7, wherein said means for jetting ink drive said piezoelectric member to ground said electrodes of a pressure chamber from which an ink droplet is to be jetted, and apply voltages selectively either to an electrode in one or both of the pressure chambers immediately adjacent to said pressure chamber from which an ink droplet is to be jetted.

10. An ink jet print head according to claim 7 wherein said side walls include a first layer formed of a piezoelectric member and a second layer formed of a member having lower rigidity than said piezoelectric member.

11. A method of driving an ink jet print head comprising:

a plurality of pressure chambers divided by a plurality of side walls formed at least partially of a piezoelectric member;

electrodes formed on inner surfaces of said pressure chambers such that a contact said piezoelectric members; and means for jetting ink in said pressure chambers by applying voltages to said electrodes which causes deformation in shearing strain mode to said side walls;

said method including the steps of:

applying different voltages to electrodes of different side walls of each pressure chamber so as to effect different operating characteristics in shearing strain mode by said different side walls of each pressure chamber; and applying, for each of said pressure chambers, voltages to said electrodes to deform either one or both of said side walls which surround the pressure chamber.

12. A method of driving an ink jet print head comprising a plurality of pressure chambers divided by a plurality of side walls formed at least partially of a piezoelectric member;

electrodes formed on inner surfaces of said pressure chambers such that they contact said piezoelectric member;

ink jets formed within said pressure chambers; and means for jetting ink in said pressure chambers by applying voltages to said electrodes which causes deformation in shearing strain mode to said side walls; said method including the steps of:

alternately connecting each of said electrodes to two electric sources having different voltage levels for every two pressure chambers; and driving said piezoelectric member to ground said electrodes of a pressure chamber from which ink droplet is to be jetted, and applying voltages selectively either to an electrode in one or both of the pressure chambers immediately adjacent to said pressure chamber.

13. A method of driving an ink jet print head comprising a plurality of pressure chambers divided by a plurality of side walls formed at least partially of a piezoelectric member;

electrodes formed on inner surfaces of said pressure chambers such that they contact said piezoelectric member;

ink jets formed within said pressure chambers; and means for jetting ink in said pressure chambers by applying voltages to said electrodes thereby causing deformation in shearing strain mode to said side walls; said method including the steps of:

arranging said side walls such that side walls surrounding each pressure chamber have different operating characteristics of shearing strain mode from one another; and applying, for each of said pressure chambers, a voltage to electrodes to deform either one or both of said side walls which surround the pressure chamber.

14. A method of driving an ink jet print head according to claim 13, wherein said side walls disposed on both sides of each one of said pressure chambers are formed of different widths along a direction of arrangement of said pressure chambers such that operating characteristics of side walls disposed on both sides of each pressure chamber are different from one another.

* * * * *